US010988893B2

(12) United States Patent
Taylor et al.

(10) Patent No.: US 10,988,893 B2
(45) Date of Patent: Apr. 27, 2021

(54) DRYER APPLIANCE WITH SLIDE BEARING ASSEMBLIES INCLUDING WEAR DETECTION FEATURES

(71) Applicant: Haier US Appliance Solutions, Inc., Wilmington, DE (US)

(72) Inventors: Alexis Christina Taylor, Louisville, KY (US); Brad Herschler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 84 days.

(21) Appl. No.: 16/515,285

(22) Filed: Jul. 18, 2019

(65) Prior Publication Data

US 2021/0017694 A1 Jan. 21, 2021

(51) Int. Cl.
*D06F 58/08* (2006.01)
*D06F 58/50* (2020.01)

(52) U.S. Cl.
CPC ..... *D06F 58/08* (2013.01); *D06F 58/50* (2020.02)

(58) Field of Classification Search
CPC ..... D06F 58/06; D06F 58/08; D06F 58/50; D06F 58/02; D06F 58/20
USPC ..... 34/601, 602, 108, 441, 526
See application file for complete search history.

(56) References Cited

U.S. PATENT DOCUMENTS

| | | | | |
|---|---|---|---|---|
| 4,604,604 | A | 8/1986 | Mann | |
| 5,608,376 | A | 3/1997 | Ito et al. | |
| 5,731,650 | A | 3/1998 | Scheucher | |
| 6,080,982 | A | 6/2000 | Cohen | |
| 10,392,741 | B1 * | 8/2019 | Adamczyk | D06F 58/30 |
| 2009/0083992 | A1 * | 4/2009 | Prajescu | D06F 58/06 34/601 |
| 2009/0223083 | A1 | 9/2009 | LeCrone | |

FOREIGN PATENT DOCUMENTS

| | | | | |
|---|---|---|---|---|
| CN | 1715529 | A | 1/2006 | |
| CN | 201178670 | Y | 1/2009 | |
| DE | 102016104980 | A1 * | 9/2017 | D06F 58/30 |

* cited by examiner

*Primary Examiner* — John P McCormack
(74) *Attorney, Agent, or Firm* — Dority & Manning, P.A.

(57) ABSTRACT

A dryer appliance including a slide bearing assembly mounted to a top bearing for supporting a rotating drum and including a wear indication device is provided. The slide bearing assembly includes a contact circuit including two electrical leads positioned on a top bearing of the dryer appliance. A slide bearing is positioned over the contact circuit for supporting a drum during rotation and maintaining an open circuit between the two electrical leads. A controller monitors the resistance across the two electrical leads, determines that a slide bearing failure has occurred when the resistance drops (e.g., due to worn slide bearings), and notifies the user accordingly.

20 Claims, 5 Drawing Sheets

DRYER APPLIANCE WITH SLIDE BEARING ASSEMBLIES INCLUDING WEAR DETECTION FEATURES

FIELD OF THE INVENTION

The present subject matter relates generally to dryer appliances, and more particularly to wear detection systems and features for slide bearing assemblies for dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance.

Conventional dryer appliances include a top bearing that supports a front lip of the drum during rotation. In this regard, the top bearing is typically a plastic part that has one or more slide bearings or other durable, low friction pads or members which support the drum during rotation. However, over repeated cycles and many hours of drum rotation, these slide bearings may inevitably wear down or away, causing the drum to rotate instead against the less durable top bearing. If the slide bearings are not replaced soon after their end-of-life or failure, damage to the top bearing and/or drum may quickly occur, resulting in a very expensive replacement components and repair procedures. Notably, conventional dryer appliances have no way of detecting when a slide bearing has worn away or failed.

Accordingly, an improved slide bearing system for a dryer appliance would be useful. More specifically, a dryer appliance having slide assemblies which include wear indications devices or systems would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided including a cabinet, a drum rotatably mounted within the cabinet, the drum defining a chamber for receipt of clothes for drying, and a top bearing positioned proximate a front of the drum. A slide bearing assembly is positioned between the drum and the top bearing and includes a contact circuit having two electrical leads and a slide bearing positioned over the contact circuit for supporting the drum during rotation.

In another aspect of the present disclosure, a slide bearing assembly for a dryer appliance is provided. The slide bearing assembly includes a contact circuit including two electrical leads and being positioned on a top bearing of the dryer appliance, a slide bearing positioned over the contact circuit for supporting a drum during rotation, and a controller communicatively coupled to the contact circuit. The controller is configured for detecting the failure of the slide bearing and notifying a user when the failure of the slide bearing occurs.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
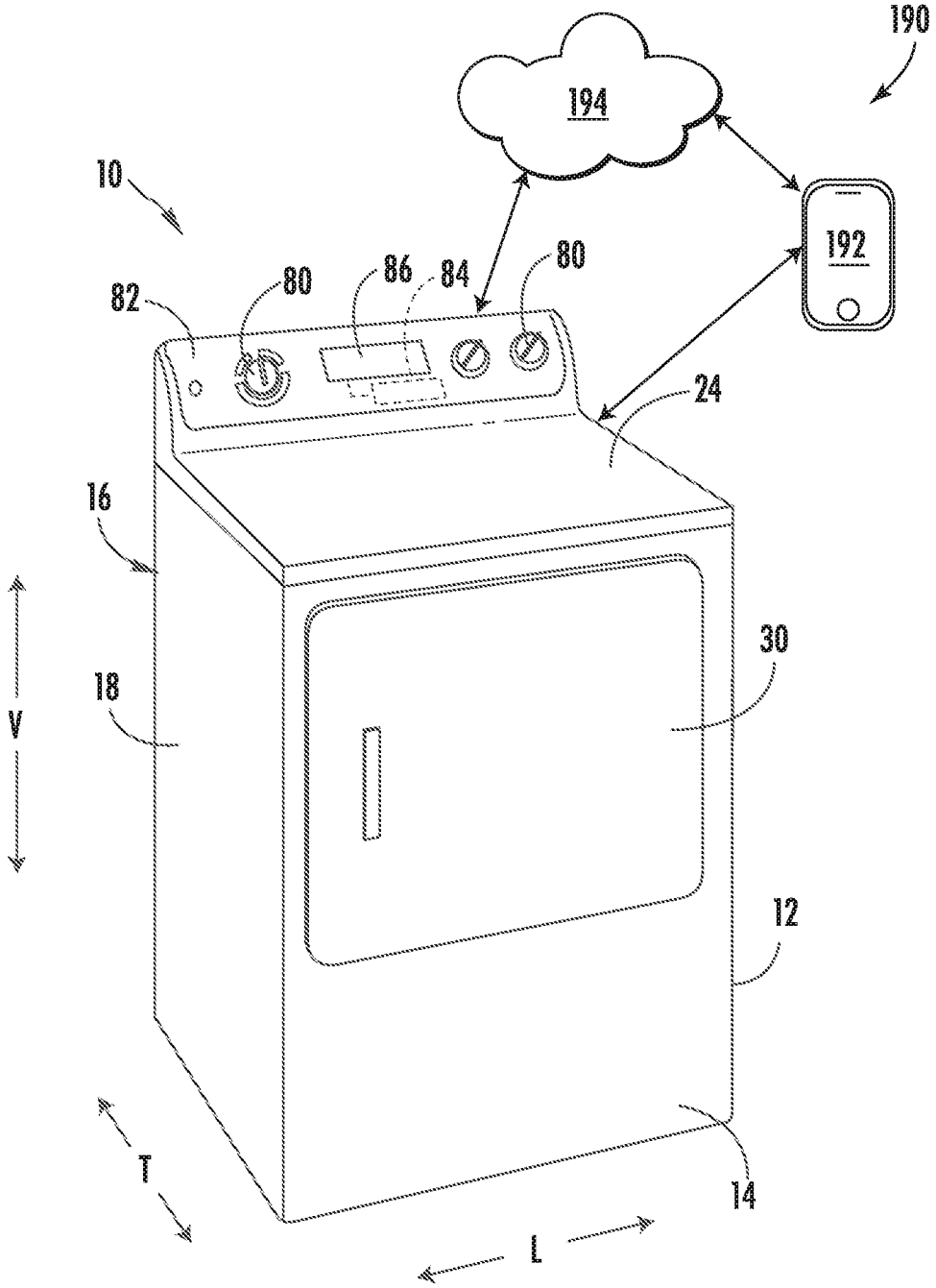
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
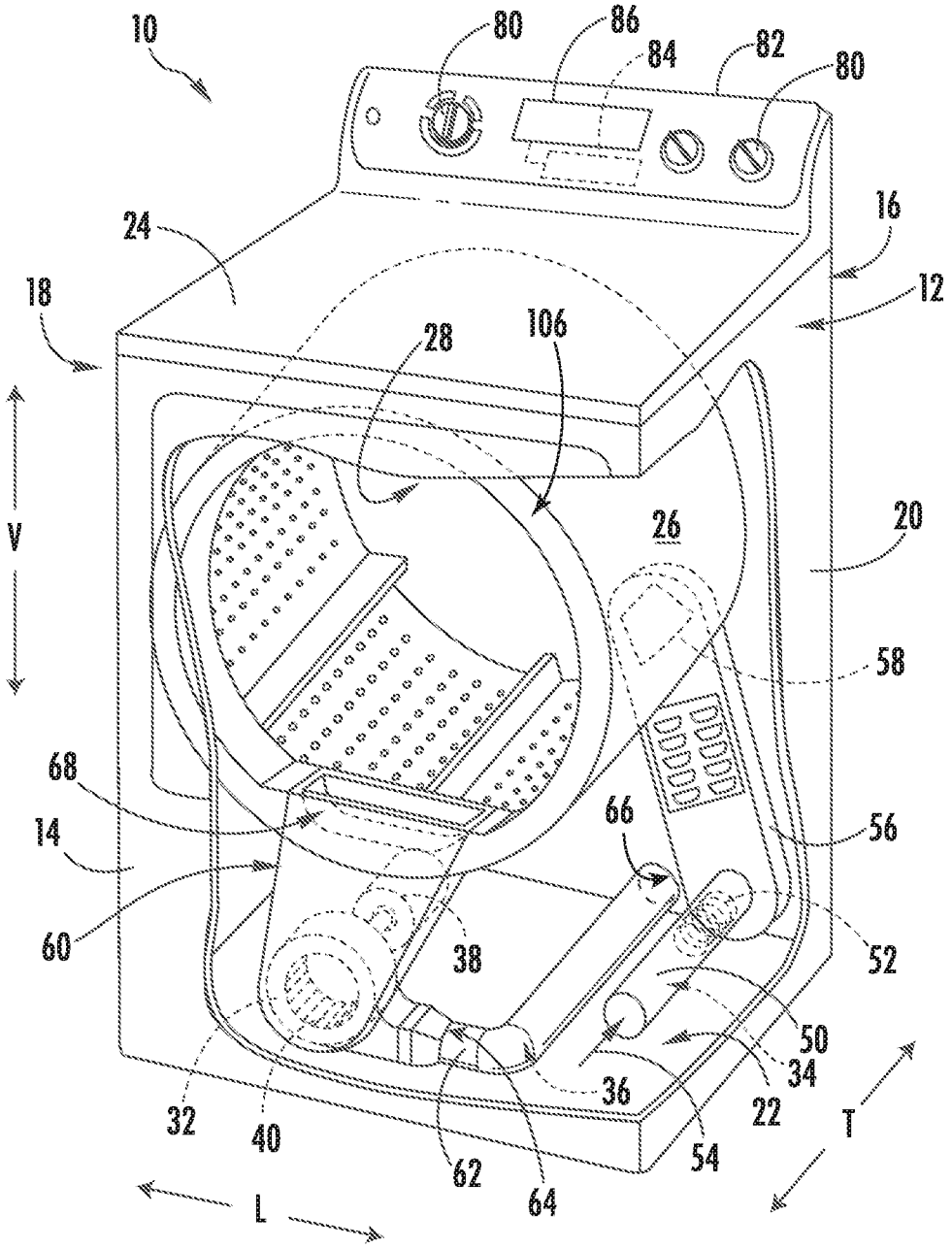
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Figure 3:
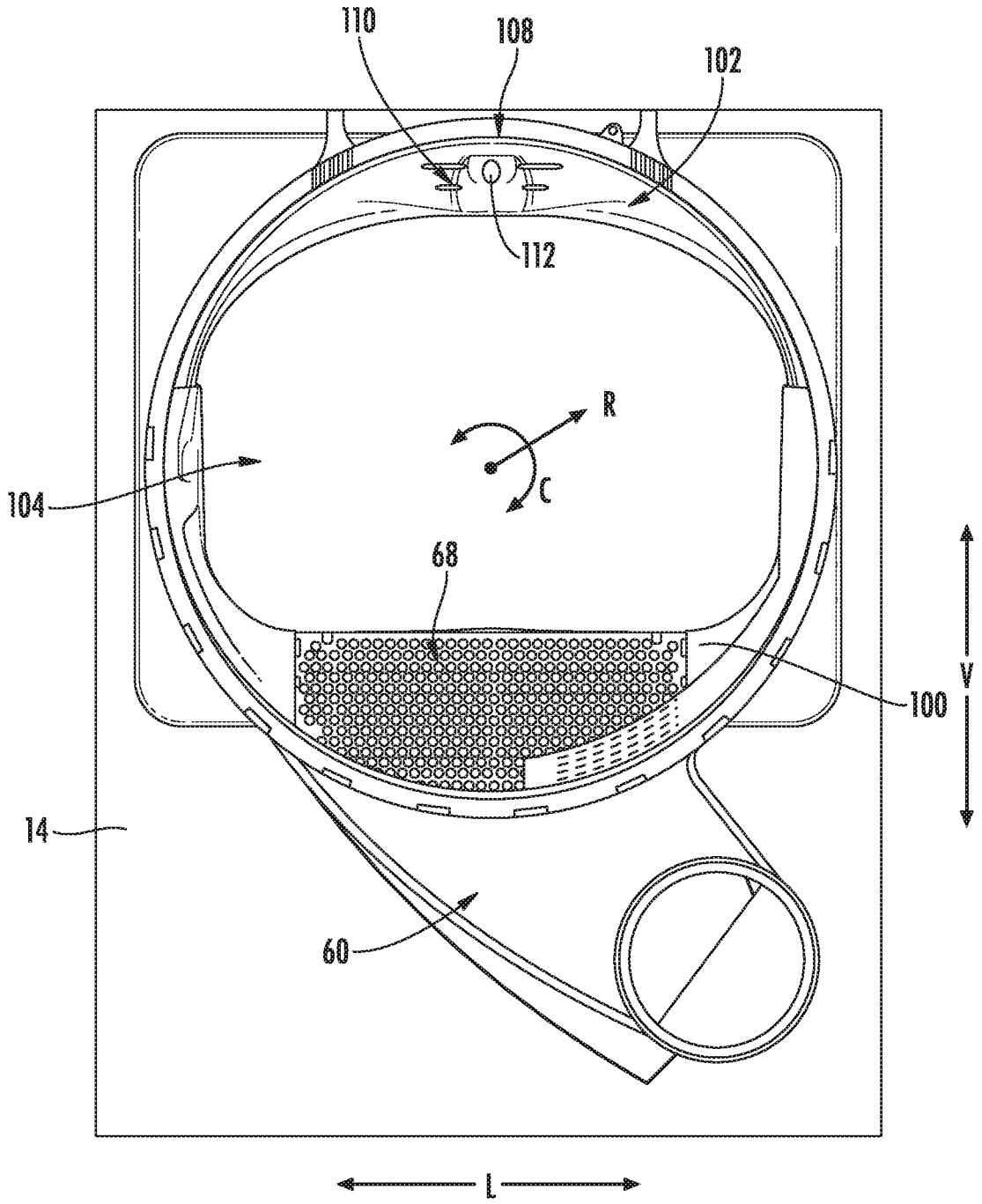
FIG. 3 provides a rear view of a top bearing of the exemplary dryer appliance of FIG. 1 according to an exemplary embodiment of the present subject matter.
Figure 4:
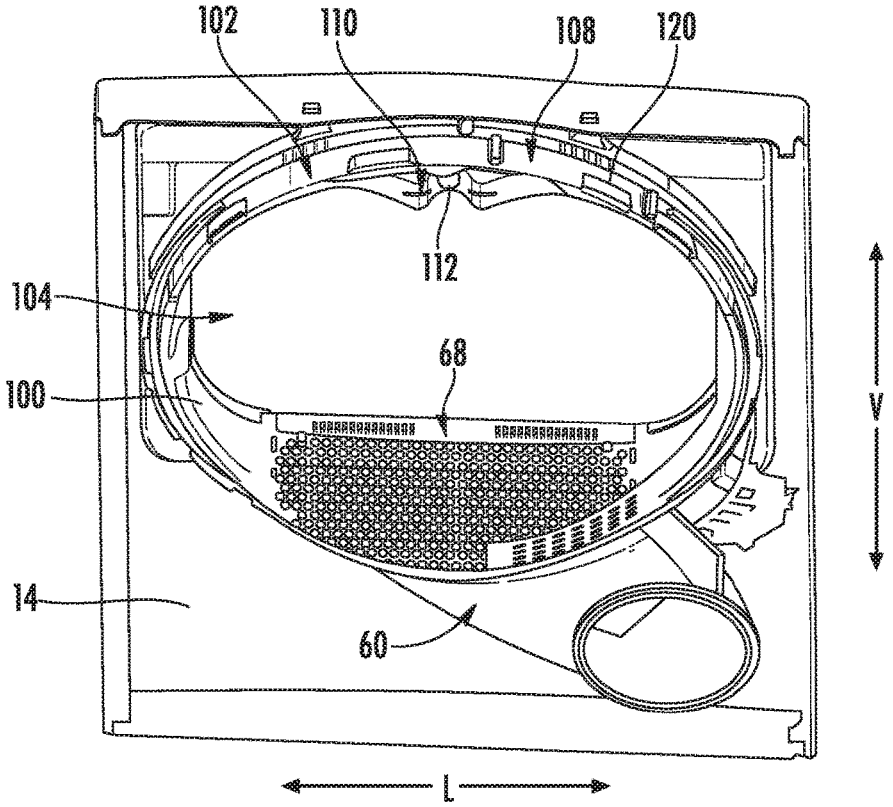
FIG. 4 provides a rear perspective view of the exemplary top bearing of FIG. 3 according to an exemplary embodiment of the present subject matter.

Referring now generally to FIGS. 3 and 4, dryer appliance 10 may include a front bulkhead 100 and a top bearing 102 mounted to front panel 14. Specifically, for example, front bulkhead 100 may be mounted directly to a backside of front panel 14 and may define an opening 104 through which chamber 28 may be accessed. Front bulkhead 100 may generally define a front end of chamber 28. In addition, front bulkhead 100 may house or support various components of dryer appliance, such as trap duct 60, filter portion 68, sensors, or other dryer components.

Top bearing 102 may be mounted directly to front bulkhead 102 and may be generally configured for supporting drum 26 as it rotates and housing various other dryer components. In this regard, top bearing 102 is generally positioned at a front of drum 26 and cabinet 12, e.g., proximate a front lip 106 (see FIG. 2) of drum 26. Top bearing 102 defines an outer surface 108 on which drum 26 may rotate, as described in more detail below. As best shown in FIG. 3, top bearing 102 may define a bulb housing 110 for receiving a light bulb 112 for illuminating chamber 28 when desired. The electronics (not shown) for powering light bulb 112 may be housed behind the top bearing 102, e.g., within a cavity and may be operably coupled with controller 84 which may regulate operation of light bulb 112. According to exemplary embodiments, top bearing 102 may also house other sensors, such as temperature and/or humidity sensors, or other dryer components.

Referring now generally to FIGS. 3 through 8, top bearing 102 will be described in more detail according to exemplary embodiments of the present subject matter. As mentioned briefly above, top bearing 102 may be mounted at a fixed location behind front panel 14 for supporting drum 26 as it rotates. Specifically, top bearing 102 may extend along a circumferential direction C around a top half of drum 26. Top bearing 102 is typically positioned inside front lip 106 of drum 26 along a radial direction R such that the weight of drum 26 and its contents is vertically supported by a top outer surface 108 of top bearing 102.

Figure 5:
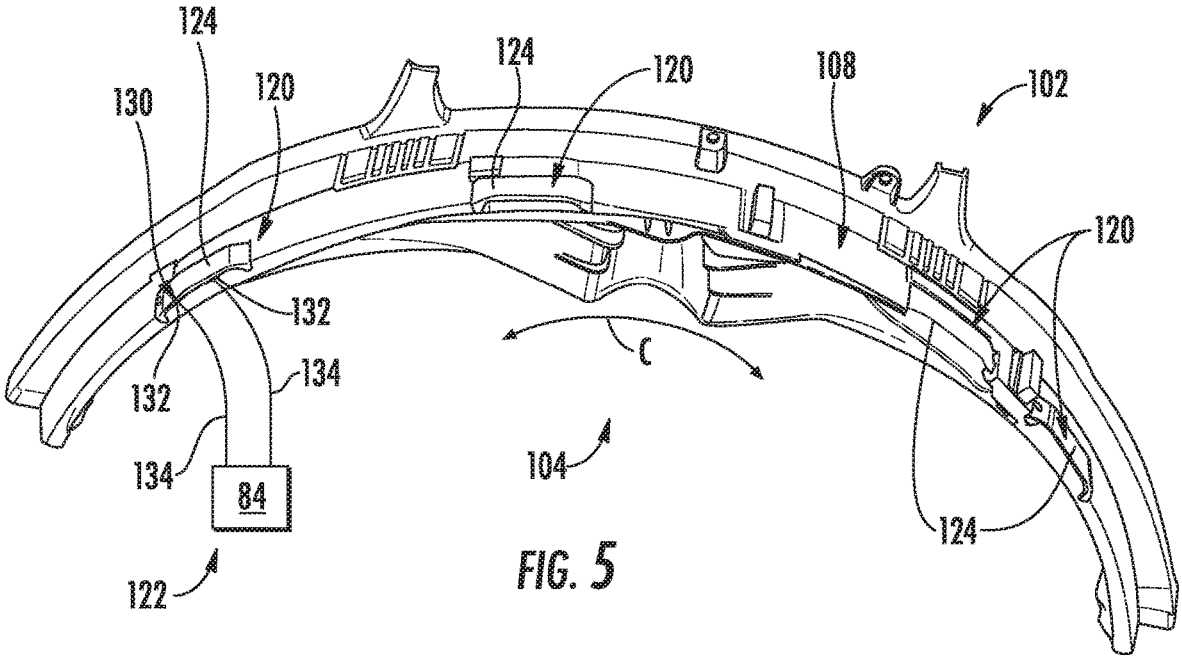
FIG. 5 provides a perspective view of the exemplary top bearing of FIG. 3 according to an exemplary embodiment of the present subject matter.
Figure 6:
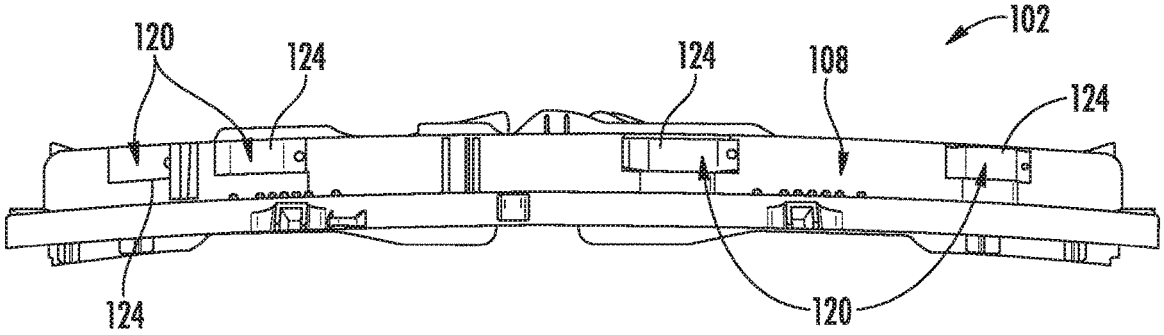
FIG. 6 provides a top view of the exemplary top bearing of FIG. 3 according to an exemplary embodiment of the present subject matter.
Figure 7:
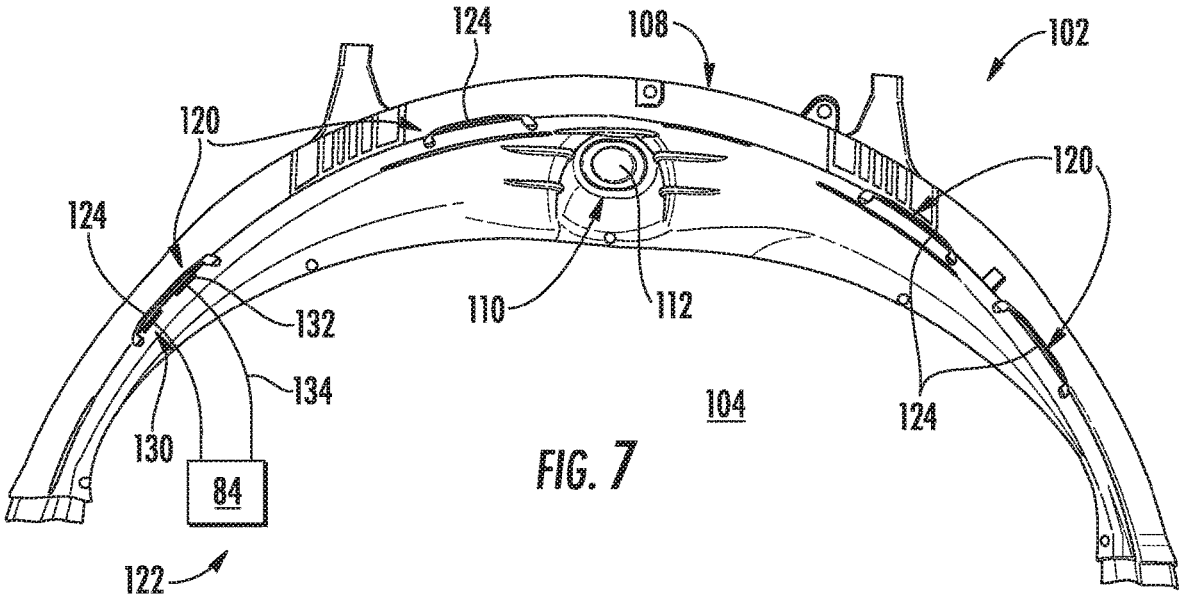
FIG. 7 provides a close-up rear view of the exemplary top bearing of FIG. 3 according to an exemplary embodiment of the present subject matter.

More specifically, top bearing 102 may support drum 26 using one or more slide bearing assemblies 120 which are mounted to top bearing 102 and are positioned between top bearing 102 and drum 26. Specifically, as best shown in FIGS. 5 through 7, dryer appliance 100 may include four slide bearing assemblies 120 that are spaced apart along the circumferential direction C on a top outer surface 108 of top bearing 102. In this manner, slide bearing assemblies 120 may directly engage in support front lip 106 of drum 26. Although four bearing assemblies 120 are illustrated, it should be appreciated that according to alternative embodiments, dryer appliance 10 may include any suitable number, size, positioning, and configuration of slide bearing assemblies 120 as needed to support the weight and rotation of drum 26.

Figure 8:
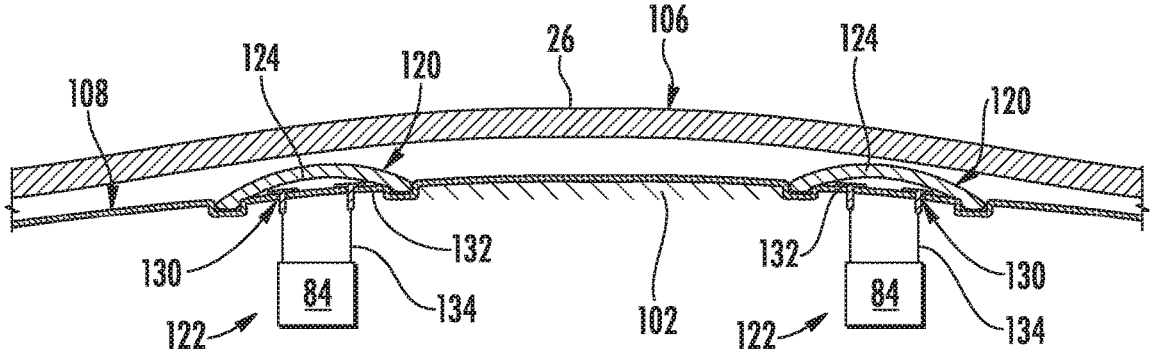
FIG. 8 provides a rear view of a dryer drum riding on the exemplary top bearing of FIG. 3 according to an exemplary embodiment of the present subject matter.

Referring now specifically to FIG. 8, the construction of an exemplary slide bearing assembly 120 will be described according to exemplary embodiments the present subject matter. As illustrated, slide bearing assembly includes a contact circuit 122 and a slide bearing 124. Slide bearing 124 is directly mounted to outer surface 108 of top bearing 102 and is designed for directly contacting and supporting drum 26 during rotation. In this regard, slide bearing 124 may be constructed from any suitably durable material to withstand the friction and interaction between drum 26 and top bearing 102 for a suitable lifetime of slide bearing 124. For example, slide bearing 124 may be constructed from a suitably rigid and durable plastic, rubber or other suitable polymer material. In addition, for reasons described in detail below, it is preferable that slide bearing 124 be formed from an electrically insulating or nonconductive material.

Notably, slide bearing 124 will typically wear out or degrade over the lifetime of dryer appliance 10. In this regard, after a certain period of time, the rubber or other material that makes up slide bearing 124 will wear away such that drum 26 no longer slides on slide bearing 124, but instead rides directly on top bearing 102. Top bearing 102 is typically not constructed of a material suitable for supporting drum 26 directly when slide bearings 124 have failed or are defective. As used herein, terms indicating that slide bearings 124 have reached their end of life, have worn down, have failed, etc. are generally intended to refer to the time at which slide bearing 124 may no longer serve its intended purpose of supporting drum 26, e.g., by maintaining separation between top bearing 102 and drum 26.

As will be described in detail below, contact circuit 122 may be any structure, device, circuit, or other mechanism suitable for detecting direct contact between drum 26 and top bearing 102. Thus, contact circuit 122 may generally be configured for providing an indication or notification to a user or maintenance technician when slide bearing 124 failure occurs. In this manner, slide bearings 124 may be quickly and easily replaced before damage to top bearing 102 or other components of dryer appliance 10 occur. Notably, replacing slide bearings 124 is a much cheaper and easier repair than if damage were to occur to top bearing 102 or other components of dryer appliance 10.

As shown in FIG. 8, according to an exemplary embodiment, contact circuit 122 comprises two or more electrical leads 130. Specifically, electrical leads 130 may be any electrically conductive contact or terminal that is exposed on or above outer surface 108 of top bearing 102. For example, according to the illustrated embodiment, each of the two electrical leads 130 terminate in flat metal plates 132 to provide additional surface area for forming a closed-circuit as described below. Electrical leads 130 further include wires 134 connected to the flat metal plates 132 and which are electrically coupled back to controller 84, or another suitable dedicated controller for contact circuit 122.

As shown, slide bearings 124 are positioned over contact circuit 122, or more specifically, over flat metal plates 132 or other suitable electrical terminals. In this manner, slide bearing 124 supports the rotation of drum 26 such that drum 26, which is typically formed from metal or another conductive material, does not contact and close the circuit between open electrical leads 130. Controller 84 may monitor a resistance or conductivity between the open electrical leads 130 throughout the lifetime of dryer appliance 10. When slide bearing 124 eventually wears out or fails, drum 26 will directly contact electrical leads 130, e.g., providing a bridged electrical connection between adjacent flat metal plates 132. Specifically, controller 84 may detect that contact circuit 122 has been shorted or closed when the resistance decreases or falls below some threshold resistance. Controller 84 may detect that the contact circuit 122 has been closed and may generate a responsive action.

Although contact circuit 122 is described above as comprising two electrical leads 130 electrically coupled flat metal plates 132, it should be appreciated that variations and modifications to slide bearing assemblies 120 may be made while remaining within scope of the present subject matter. For example, according to alternative embodiments, only one (or fewer than all) of the plurality of slide bearing assemblies 120 includes the contact circuit 122. In addition, slide bearing assemblies 120 could instead include a push-button or a pressure sensor that is communicatively coupled to controller 84 through the two electrical leads 130. In this regard, when slide bearing 124 wears down, drum may provide a threshold amount of pressure on to the pressure sensor, thereby triggering controller 84 to provide a failure notification to a user.

For example, according to exemplary embodiments, the responsive action implemented by controller 84 may be providing a notification to a user that slide bearing failure has occurred. In this regard, controller 84 may trigger a particular message on display 86 or may illuminate an indicator light to inform a user that service is needed. According to still other embodiments, as described below, controller 84 may communicate with a remote server, an external network, and/or a remote device such as a mobile phone to provide such indication.

Referring again to FIG. 1, a schematic diagram of an external communication system 190 will be described according to an exemplary embodiment of the present subject matter. In general, external communication system 190 is configured for enabling communication between a user, an appliance, and a remote server or network. Specifically, according to the illustrated embodiment, dryer appliance 10 may communicate with a remote device 192 either directly (e.g., through a local area network (LAN), Wi-Fi, Bluetooth, etc.) or indirectly (e.g., via a network 194), as well as with a remote server (not shown), e.g., to receive notifications, provide confirmations, input operational data, etc.

In general, remote device 192 may be any suitable device for providing and/or receiving communications or commands from a user. In this regard, remote device 192 may include, for example, a personal phone, a tablet, a laptop computer, or another mobile device. In addition, or alternatively, communication between the appliance and the user may be achieved directly through an appliance control panel (e.g., control panel 82).

In general, network 194 can be any type of communication network. For example, network 194 can include one or more of a wireless network, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g. HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dryer appliance comprising:

a cabinet;

a drum rotatably mounted within the cabinet, the drum defining a chamber for receipt of clothes for drying;

a top bearing positioned proximate a front of the drum; and a slide bearing assembly positioned between the drum and the top bearing, the slide bearing assembly comprising:

a contact circuit comprising two electrical leads; and a slide bearing positioned over the contact circuit for supporting the drum during rotation.

2. The dryer appliance of claim 1, wherein the two electrical leads terminate in flat metal plates.

3. The dryer appliance of claim 1, wherein the two electrical leads form an open circuit while the slide bearing is positioned between the two electrical leads and the drum, and wherein the drum contacts the two electrical leads and forms a closed circuit when the slide bearing fails or is worn away.

4. The dryer appliance of claim 1, wherein the contact circuit comprises:

a push button or pressure sensor communicatively coupled to a controller through the two electrical leads.

5. The dryer appliance of claim 1, wherein the slide bearing assembly is positioned proximate a front lip of the drum.

6. The dryer appliance of claim 1, wherein the slide bearing assembly is mounted to the top bearing.

7. The dryer appliance of claim 1, wherein the slide bearing is formed from an insulating plastic or rubber material.

8. The dryer appliance of claim 1, wherein the dryer appliance comprises a plurality of slide bearing assemblies spaced apart along a circumferential direction around the top bearing.

9. The dryer appliance of claim 1, further comprising a controller communicatively coupled to the contact circuit, the controller being configured for:

detecting the failure of the slide bearing; and notifying a user when the failure of the slide bearing occurs.

10. The dryer appliance of claim 9, wherein detecting the failure of the slide bearing comprises:

measuring a resistance between the two electrical leads; and determining that the two electrical leads have been electrically shorted when the resistance decreases.

11. The dryer appliance of claim 9, wherein notifying the user of the failure of the slide bearing comprises illuminating an indicator light or displaying a warning message on a display of the dryer appliance.

12. The dryer appliance of claim 9, wherein notifying the user of the failure of the slide bearing comprises sending a notification to the user's mobile device.

13. A slide bearing assembly for a dryer appliance, the slide bearing assembly comprising:

a contact circuit comprising two electrical leads and being positioned on a top bearing of the dryer appliance;

a slide bearing positioned over the contact circuit for supporting a drum during rotation; and a controller communicatively coupled to the contact circuit, the controller being configured for:

detecting the failure of the slide bearing; and notifying a user when the failure of the slide bearing occurs.

14. The slide bearing assembly of claim 13, wherein the two electrical leads terminate in flat metal plates.

15. The slide bearing assembly of claim 13, wherein the two electrical leads form an open circuit while the slide bearing is positioned between the two electrical leads and the drum, and wherein the drum contacts the two electrical leads and forms a closed circuit when the slide bearing fails or is worn away.

16. The slide bearing assembly of claim 13, wherein the contact circuit comprises:

a push button or pressure sensor communicatively coupled to the controller through the two electrical leads.

17. The slide bearing assembly of claim 13, wherein the slide bearing is formed from an insulating plastic or rubber material.

18. The slide bearing assembly of claim 13, wherein the dryer appliance comprises a plurality of slide bearing assemblies spaced apart along a circumferential direction around the top bearing.

19. The slide bearing assembly of claim 13, wherein detecting the failure of the slide bearing comprises:

measuring a resistance between the two electrical leads; and determining that the two electrical leads have been electrically shorted when the resistance decreases.

20. The slide bearing assembly of claim 13, wherein notifying the user of the failure of the slide bearing comprises illuminating an indicator light or displaying a warning message on a display of the dryer appliance.

* * * * *